US005347255A

United States Patent [19]

Saitoh et al.

[11] Patent Number: 5,347,255

[45] Date of Patent: Sep. 13, 1994

[54] VARIABLE INDUCTANCE COIL DEVICE

[75] Inventors: Yutaka Saitoh; Shinichiro Ito; Yukiharu Kinoshita, all of Tokyo, Japan

[73] Assignee: TDK Corporation, Tokyo, Japan

[21] Appl. No.: 18,102

[22] Filed: Feb. 17, 1993

[30] Foreign Application Priority Data

May 7, 1992 [JP] Japan ..... 4-114506

[51] Int. Cl.[5] ..... H01F 21/06

[52] U.S. Cl. ..... 336/83; 336/134; 336/136

[58] Field of Search ..... 336/83, 136, 134, 132, 336/212, 130

[56] References Cited

U.S. PATENT DOCUMENTS

| | | | |
|---|---|---|---|
| 2,130,815 | 9/1938 | Riepka | 336/83 |
| 2,457,806 | 1/1949 | Crippa | 336/83 |
| 3,119,975 | 1/1964 | Arita | 336/136 |
| 3,162,829 | 12/1964 | Wildy et al. | 336/136 |
| 3,227,980 | 1/1966 | Roser | 336/83 |
| 3,259,861 | 7/1966 | Walker | 336/136 |
| 3,358,255 | 12/1967 | Digilio | 336/83 |
| 3,471,815 | 10/1969 | Grant et al. | 336/83 |
| 3,500,274 | 3/1970 | Matsuura et al. | 336/136 |
| 3,979,706 | 9/1976 | Jennings | 336/83 |
| 4,558,295 | 12/1985 | Olmsted et al. | 336/83 |
| 4,706,058 | 11/1987 | Barbier et al. . | |

FOREIGN PATENT DOCUMENTS

| | | | |
|---|---|---|---|
| 1011087 | 6/1957 | Fed. Rep. of Germany | 336/83 |
| 0108305 | 5/1984 | Fed. Rep. of Germany . | |
| 51-62741 | 5/1976 | Japan . | |
| 51-75545 | 6/1976 | Japan . | |
| 55-50372 | 12/1980 | Japan . | |
| 56-24363 | 6/1981 | Japan . | |
| 1518938 | 7/1978 | United Kingdom . | |

*Primary Examiner*—Thomas J. Kozma

*Attorney, Agent, or Firm*—Knobbe, Martens, Olson & Bear

[57] ABSTRACT

The variable inductance coil device having an outer magnetic member, a bobbin member, a coil member and an inner magnetic member. A female thread (thread portion) is provided in the inner periphery of the tube of the bobbin member, and a male thread (thread portion) which meets with the female thread of the tube is provided in the outer periphery of the inner magnetic member. The inductance varies accurately by rotating and moving the inner magnetic member. Since the outer magnetic member is formed in the closed shape, the leakage flux can be lowered.

3 Claims, 8 Drawing Sheets

VARIABLE INDUCTANCE COIL DEVICE

BACKGROUND OF THE INVENTION

1. Field of the Invention

This invention relates to a variable inductance coil device such as a transformer or a choke coil.

2. Description of the Prior Art

For a magnetic core which is used in a transformer or a choke coil, an E-E type (Japanese Patent Publication No. 50372/1980), an E-I type (Japanese Patent Publication No. 24363/1981) and a drum type have been conventionally well-known in the art.

In the E-E type magnetic core, a pair of E-shaped cores made of magnetic material such as ferrite is positioned so that each leg of the cores is opposed each other, wherein a gap is provided between each end of the center legs in order to prevent magnetic saturation. The E-I type magnetic core combines an E-shaped core and an I-shaped core, wherein there is a gap provided on the end of the center leg of the E-shaped core. The drum type core literally uses the drum-shaped core.

However, a method for winding wire around the above-mentioned magnetic core having the gap has frequently caused inductance errors which are induced by dimensional errors in the magnetic core, dimensional errors caused during manufacturing of the gaps, and errors in magnetic permeability of the core. For example, if a choke coil has an effective permeability of around 100, the errors of the inductance is ±21% in the E-E type and ±16% in the E-I type.

In case of the drum-type magnetic core, the inductance error is relatively small for ±6%. However, as illustrated in a diagram of FIG. 7 showing distribution of leakage flux (unit in the diagram is expressed in gauss), the leakage flux near the drum core turns out to be very large, about 20 gauss.

SUMMARY OF THE INVENTION

An objective of the present invention is to provide a variable inductance coil device having small leakage flux and highly accurate inductance.

In order to accomplish the above-described objective, the present invention is characterized in that: an outer magnetic member is formed in a closed shape, a coil member is positioned within the outer magnetic member, an inner magnetic member is positioned inside the coil member and has a stopper so as to rotate itself, a thread portion enables the inner magnetic member to move relatively to the other members.

In the variable inductance coil device designed as above, the inductance can be accurately varied because the thread portion is provided therein and thus the relative movement of the inner magnetic member can be performed precisely. The relative movement can be easily adjusted by engaging a tool in the stopper so as to rotate the inner magnetic member. Furthermore, the outer magnetic member itself is formed in a closed shape, so the leakage flux can be decreased. Therefore, it is possible to provide a high precision variable inductance coil device of small inductance errors and small leakage flux.

DESCRIPTION OF THE PREFERRED EMBODIMENTS

The preferred embodiments of the present invention are described in detail in reference to FIGS. 1–10C.

Figure 1:
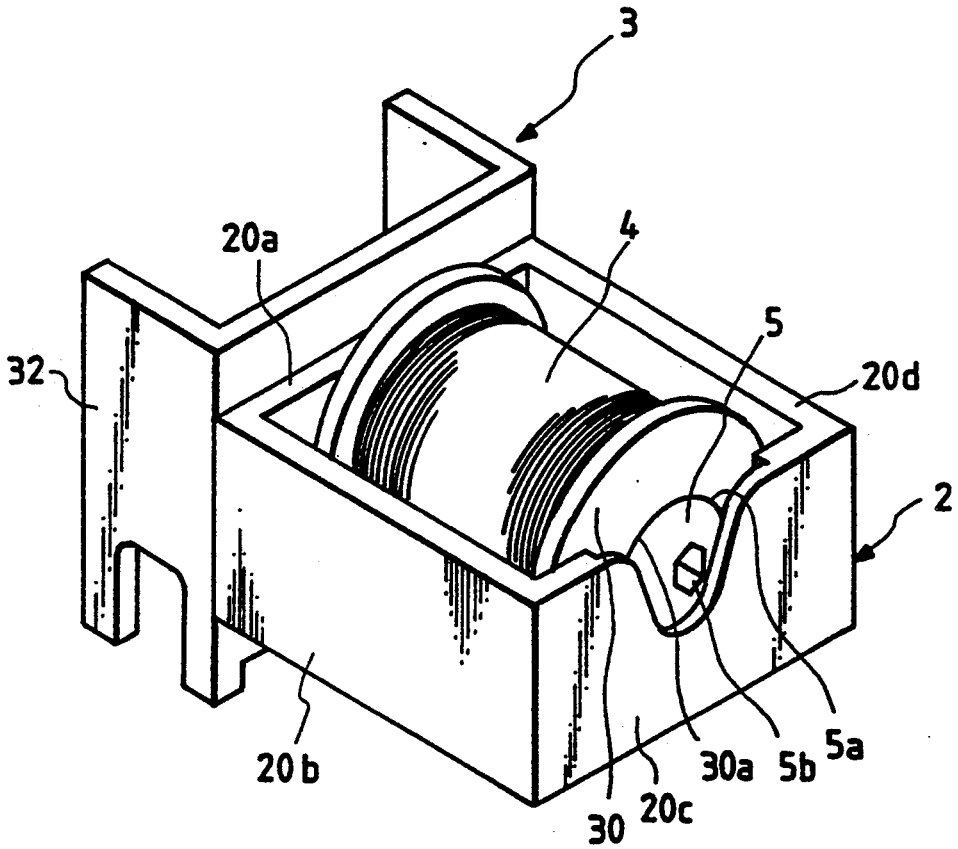
FIG. 1 is a perspective view showing one preferred embodiment of the variable inductance coil device of the present invention.

A variable inductance coil device 1 in FIG. 1 includes an outer magnetic member 2, a bobbin member 3, a coil member 4 and an inner magnetic member 5.

Figure 2:
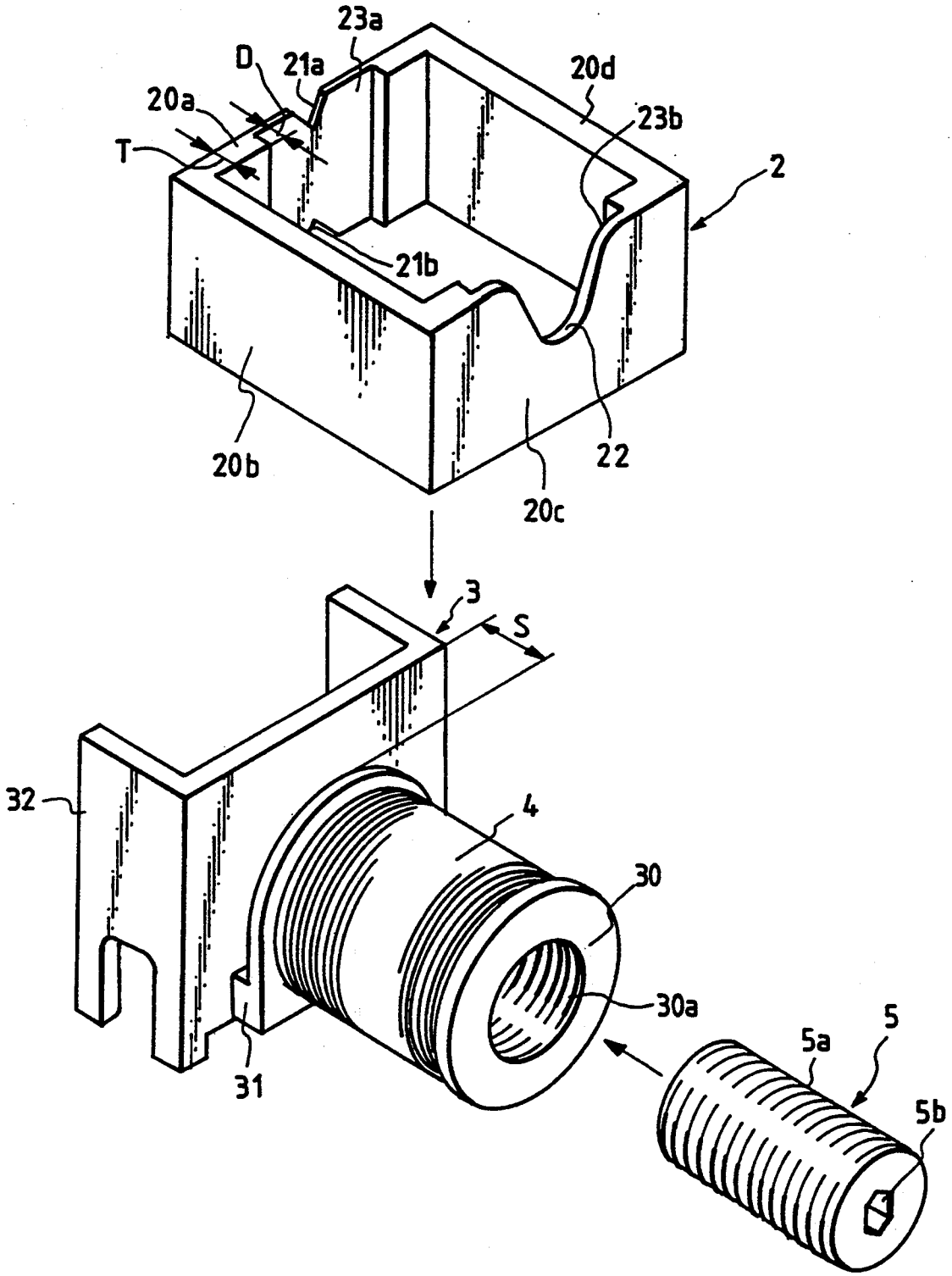
FIG. 2 is an exploded perspective view of the preferred embodiment.

The outer magnetic member 2 comprises a magnetic material such as ferrite made from manganese, iron or zinc. The outer magnetic member 2 is formed in a square shape, that is a closed shape, comprising four side plates **20*a*–20*d* having a thickness T of 2 millimeters. As shown in FIG. 2, the outer magnetic member 2 includes: V-shaped cutouts 21*a* and 21*b* which are provided in both of upper and bottom sides of the side plate 20*a*, a half-moon shaped cutout 22 which is provided in the upper side of the corresponding side plate 20*c*, and gap grooves 23*a* and 23*b* having a depth D of 0.5 millimeter which are provided in inner walls of both side plates 20*a* and 20*c*. The cutouts 21*a* and 21*b* are engaged in a projection 31*b* of the bobbin member 3 so as to restrict the horizontal position of the bobbin member 3. Since the cutouts 21*a* and 21*b* are provided in both of the upper and bottom sides on the side plate 20*a*, it is applicable to other bobbin members having other shapes. The half-moon shaped cutout 22 is provided for inserting a tool into the inner magnetic member 5. The gap grooves 23*a* and 23*b* are provided for forming gaps between the outside of the coil member 4 and the outer magnetic member 2 so that fringing flux caused around the coil member 4 (wire) is decreased and eddy current loss in the coil member 4** (wire) is also lowered.

Figure 3:
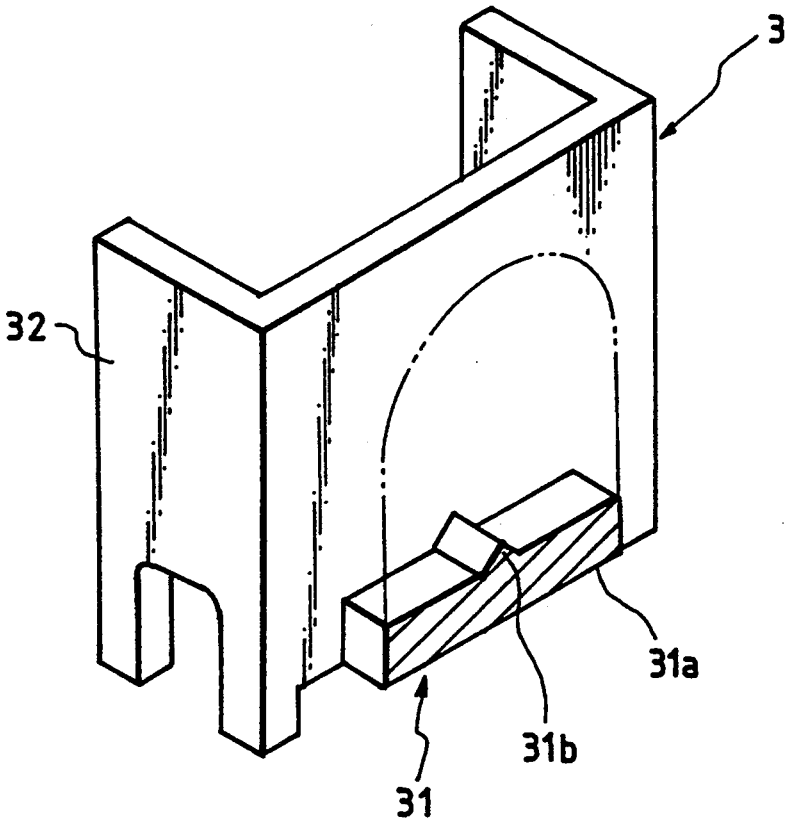
FIG. 3 is a perspective view of a main part of a bobbin member of the preferred embodiment.

As shown in FIG. 2, the bobbin member 3 formed integrally by an injection molding is made of a resin and comprises: a tube 30, a L-shaped part 31 which is connected to the end of the tube 30, and a base 32 which is connected to the L-shaped part 31. In an inner periphery of the tube 30, female thread 30*a* is formed, and the coil member 4 is adapted to be wound around an outer periphery of the tube 30. A space S between the end of the L-shaped part 31 and the base 32 is about 2–2.2 millimeters so as to restrain the position of the outer magnetic member 2 in an axial direction. As shown in FIG. 3, in a horizontal part 31*a* of the L-shaped part 31, there is the projection 31*b* which engages in the cutout 21*b* of the outer magnetic member 2 so that the movement of the outer magnetic member 2 in the horizontal direction can be restrained thereby.

The inner magnetic member 5 comprises a magnetic material such as ferrite which is baked metallic oxide made from manganese, iron or zinc and formed in a bar shape. As shown in FIG. 2, a male thread 5*a* which mates with the female thread 30*a* of the tube 30 is formed in an outer periphery of the inner magnetic member 5, and a hexagon-shaped concave portion 5*b* is formed as a stopper on an end surface of the inner magnetic member 5. The hexagon-shaped concave portion 5*b* is provided to insert a hexagon-shaped wrench therethrough in order to rotate the inner magnetic member 5.

In the following, a method for assembling the preferred embodiments is described.

First, the coil member 4 is wound on the outer periphery of the tube 30 of the bobbin member 3. Then, as shown in FIG. 2, the male thread 5*a* of the inner magnetic member 5 is screwed into the female thread 30*a* of the tube 30 of the bobbin member 3 so that the inner magnetic member 5 can be inserted inside the tube 30. Next, the outer magnetic member 2 is positioned at the outside of the tube 30 to form the device as shown in FIG. 1. In a further step, a hexagon wrench bar is inserted into the hexagon concave portion 5*b* of the inner magnetic member 5 so that the inductance is adjusted to desirable values by rotating the inner magnetic member 5.

Figure 4:
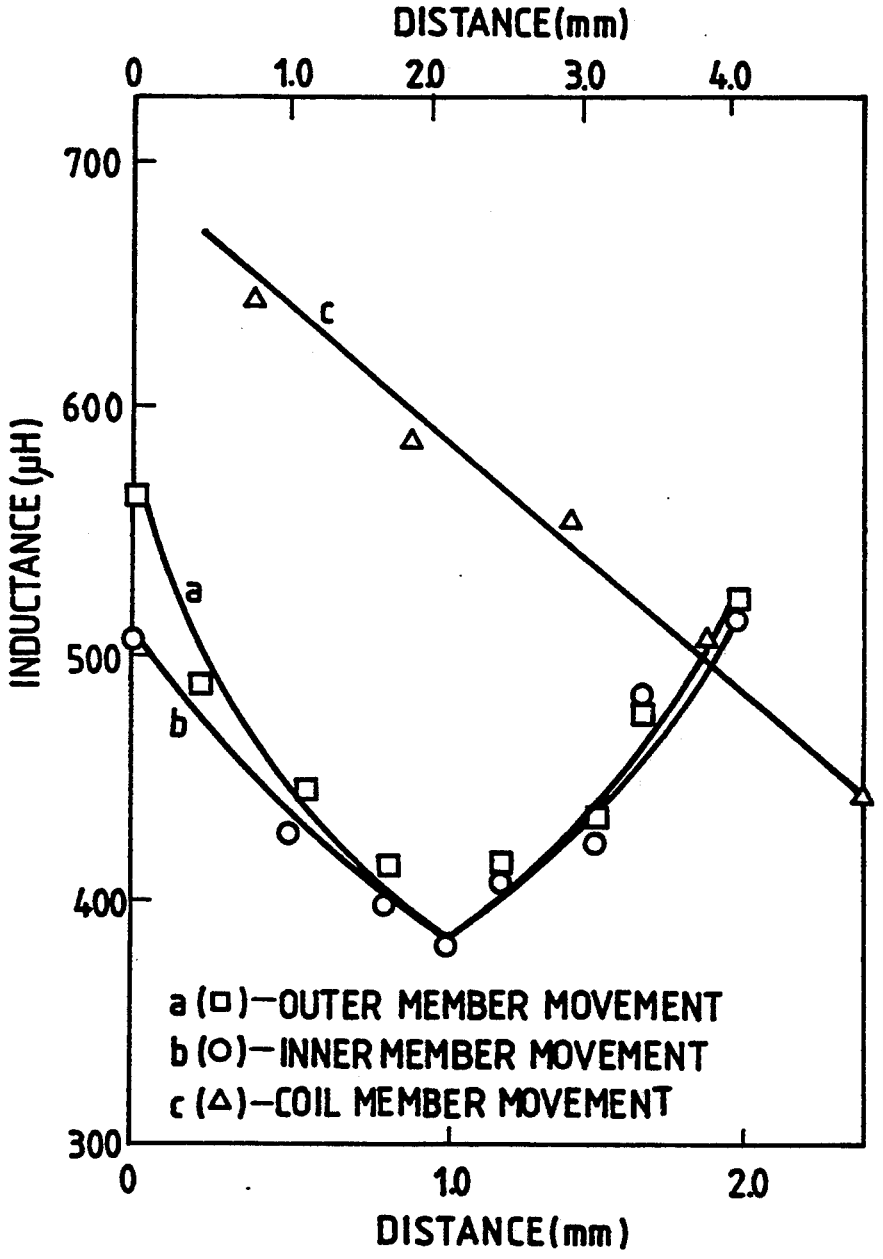
FIG. 4 is a diagram showing a variation of the inductance when either one of members in the embodiment is moved.
Figure 5:
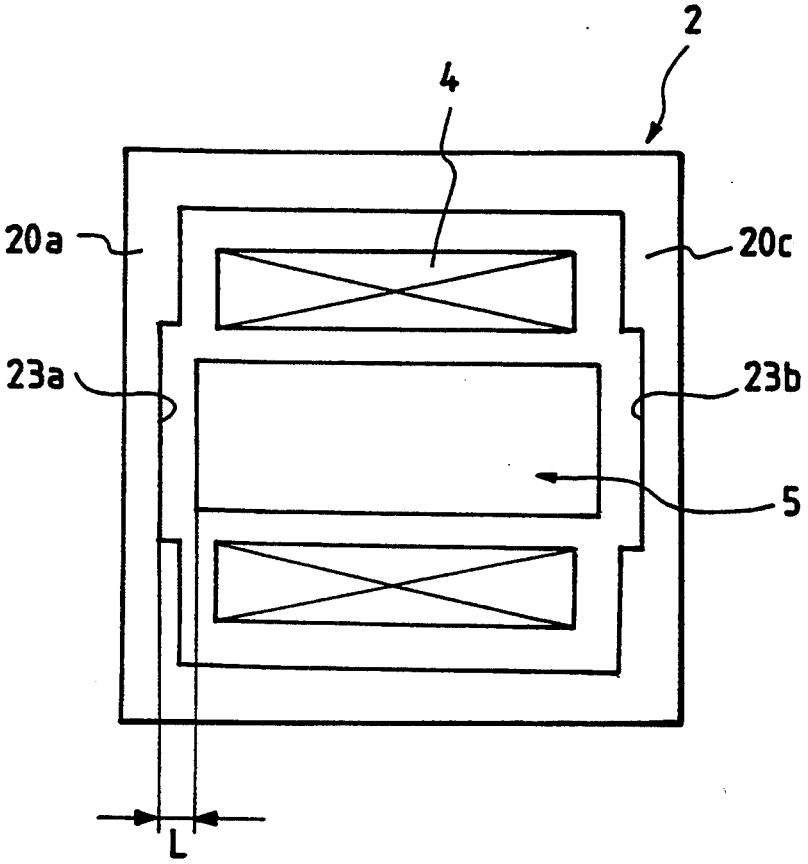
FIG. 5 is a plan view showing the distance between a gap and the inner magnetic member in the preferred embodiment.

The effect of the preferred embodiment is described in reference to FIGS. 4 and 5.

FIG. 4 is a diagram showing the fluctuation of the inductance when either one of the outer magnetic member 2, the coil member 4 or the inner magnetic member 5 is moved relatively with other members. The vertical axis shows the inductance ($\mu$H). The lower horizontal axis shows the distance L (mm) between the gap groove 23*a* in the side plate 20*a* and the inner magnetic member 5, and the upper horizontal axis shows the distance (mm) between the gap groove 23*a* and the coil member 4 as shown in FIG. 5. In the FIG. 4, a curve a shows the test result when only the outer magnetic member 2 is moved, a curve h shows when only the inner magnetic member 5 is moved, and a straight line c shows when only the coil member 3 is moved.

In accordance with FIG. 4, the coil device in the preferred embodiment can obtain a wide variable range of the inductance for 29.2% as shown in the curve b. Even if only the outer magnetic member 2 is moved, the wide variable range of the inductance can be obtained for 38.4% as shown in the curve a. Similarly, when only the coil member 3 is moved, the wide variable range can be also obtained for 38.0% as shown in the straight line c. In addition, the inductance can be easily and accurately adjusted by rotating the inner magnetic member 5, and it is possible to provide a precise coil device having small errors in the inductance.

Figure 6:
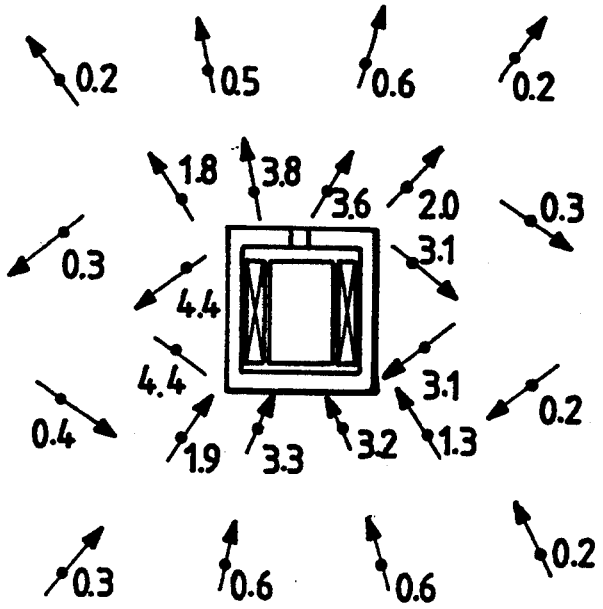
FIG. 6 is a diagram showing a distribution of the leakage flux.
Figure 7:
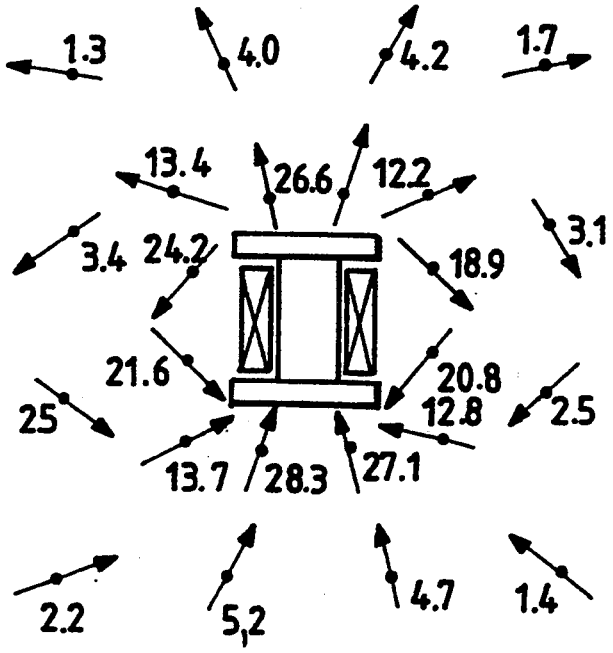
FIG. 7 is a diagram showing a distribution of the leakage flux of the conventional drum-type type coil device.

FIGS. 6 and 7 show the distribution of the leakage flux for the variable inductance coil device of the present invention and the conventional drum type coil device respectively. The unit of the numbers in the drawings is expressed in gauss. The measurement of the leakage flux for both devices has been performed with equal drive current value, number of windings of the coil, and coil inductance value. In this preferred embodiment, the outer magnetic member 2 is formed in the closed shape; thus, the leakage flux produced around the outer magnetic member 2 is about 3 gauss as shown in FIG. 6. This is one-sixth of the leakage flux of the conventional drum-type coil device in FIG. 7; the present invention has realized a lower leakage flux. In addition, the fringing flux interlinked on the coil member 4 is lowered by the gap grooves 23*a* and 23*b* provided in the outer magnetic member 2, so that the eddy current loss on the coil member 4 is also lowered.

Furthermore, the present invention can have various arrangements within the scope of the invention other than the preferred embodiment described in the foregoing. Although the present invention is described in the preferred embodiment that the inner magnetic member 5 is moved, other mechanism is also possible. For example, both of the outer magnetic member 2 and the coil member 4 can be moved, or either one of the members can be moved as well.

Figure 8:
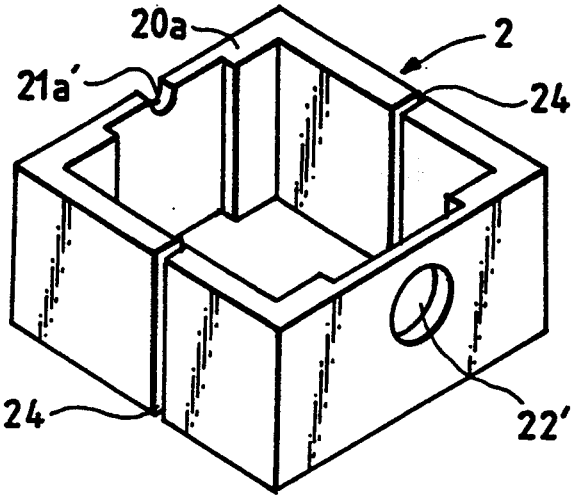
FIG. 8 is a perspective view showing one preferred embodiment of the outer magnetic member having a half-moon shaped groove for restricting the horizontal position of the bobbin member, a hole for inserting a tool in order to rotate the inner magnetic member, and a gap provided in a magnetic path.
Figure 9A:
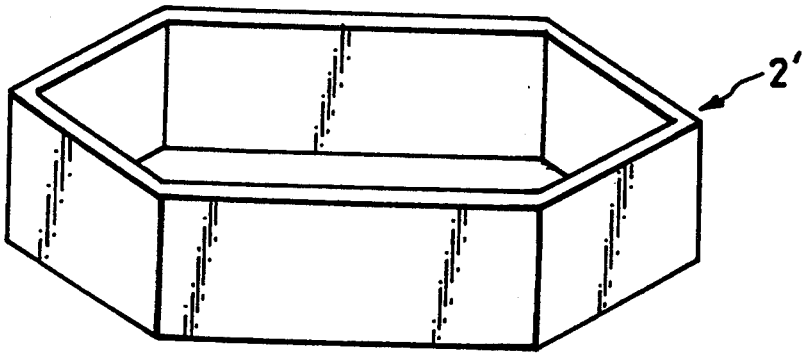
FIG. 9A is a perspective view showing one preferred embodiment of a hexagon-shaped outer magnetic member.
Figure 9B:
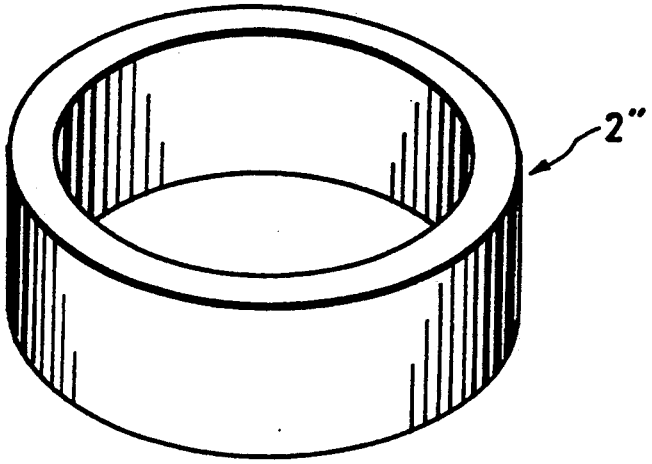
FIG. 9B is a perspective view showing one preferred embodiment of a tube-shaped outer magnetic member.

For the outer magnetic member 2, as shown in FIG. 8, a V-shaped cutout 21*a*′ can be formed only in the upper side of the side plate 20*a* instead of the cutouts 21*a* and 21*b* in both sides. The shape of the cutout can be half-moon as long as it can restrain the horizontal position of the outer magnetic member 2 when it is engaged with the projection part 31*b*. When a gap 24 is provided on the magnetic path, a highly accurate inductance can be obtained even though the leakage flux cannot be lowered. In addition, a hole 22′ as shown in FIG. 8 can be acceptable instead of the half-moon shaped cutout 22 in FIG. 2 if the tool can be inserted therethrough and the inner magnetic member 5 can be rotated thereby. Furthermore, the shape of the outer magnetic member 2 can be either a hexagon-shaped tube 2′ or a tube 2″ as shown in FIGS. 9A–9B.

Figure 10A:
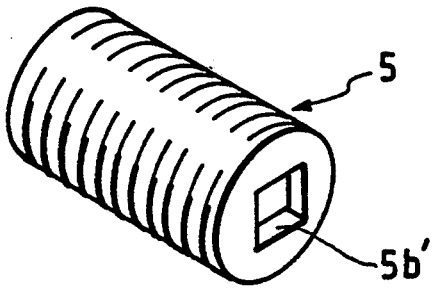
FIG. 10A is a perspective view showing one preferred embodiment of the inner magnetic member wherein the stopper for the rotating tool is formed in a concaved square-shape.
Figure 10B:
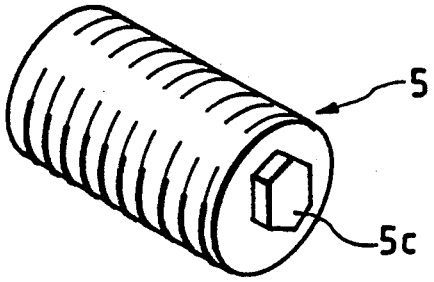
FIG. 10B is a perspective view showing one preferred embodiment of the inner magnetic member wherein the stopper is formed in a projected hexagon-shape.
Figure 10C:
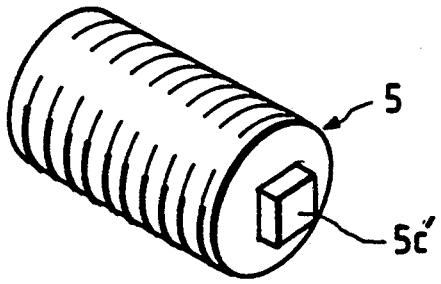
FIG. 10C is a perspective view showing one preferred embodiment of the inner magnetic member wherein the stopper is formed in a projected square-shape.

For the inner magnetic member 5, the shape of the concave portion 5*b* can be either one of a square concave portion 5*b*′, a hexagon projection 5*c*, or a square projection 5*c*′ as shown in FIGS. 10A–10C as long as the inner magnetic member 5 can be rotated by the tool.

What is claimed:

1. A variable inductance coil device comprising:

an outer magnetic member which is integrally made of a magnetic material to form a closed loop;

a bobbin member having a coil bobbin and a base, said bobbin member receiving said outer magnetic material in a spacing between said coil bobbin and said base such that a position of said coil bobbin can be adjusted relative to said outer magnetic member;

a coil member wound around said coil bobbin;

an inner magnetic member positioned inside said coil bobbin, said inner magnetic member forming two magnetic gaps at its both ends with respect to said outer magnetic member;

means for moving said inner magnetic member relative to said coil bobbin and said outer magnetic member to adjust said gaps at both ends of said inner magnetic member at the same time.

2. A variable inductance coil device as defined in claim 1, wherein a thread portion enables said inner magnetic member to move relatively with said coil bobbin and said outer magnetic member.

3. A variable inductance coil device as defined in claim 2, wherein said outer magnetic member has a cutout for inserting therethrough a tool to adjust said gaps at both ends of said inner magnetic material.

* * * * *